US007240985B2

(12) United States Patent
Rogers, IV

(10) Patent No.: US 7,240,985 B2
(45) Date of Patent: Jul. 10, 2007

(54) INK JET PRINTHEAD HAVING TWO DIMENSIONAL SHUTTLE ARCHITECTURE

(75) Inventor: Augustus J. Rogers, IV, West Linn, OR (US)

(73) Assignee: Xerox Corporation, Stamford, CT (US)

( * ) Notice: Subject to any disclaimer, the term of this patent is extended or adjusted under 35 U.S.C. 154(b) by 380 days.

(21) Appl. No.: 11/040,040

(22) Filed: Jan. 21, 2005

(65) Prior Publication Data

US 2006/0164461 A1 Jul. 27, 2006

(51) Int. Cl.
*B41J 23/00* (2006.01)

(52) U.S. Cl. ..... 347/37; 347/104

(58) Field of Classification Search ..... 347/37, 347/103, 104

See application file for complete search history.

(56) References Cited

U.S. PATENT DOCUMENTS 3,946,398 A 3/1976 Kyser et al.
4,829,324 A 5/1989 Drake et al.
5,099,256 A * 3/1992 Anderson ..... 347/103
5,192,959 A 3/1993 Drake et al.
5,221,397 A 6/1993 Nystrum
6,033,053 A 3/2000 Eun
6,394,577 B1 5/2002 Wen et al.
6,511,172 B2 1/2003 Tanno et al.
6,588,877 B2 7/2003 Sloan, Jr. et al.
2004/0056912 A1* 3/2004 Pickett ..... 347/15

* cited by examiner

*Primary Examiner*—Stephen Meier
*Assistant Examiner*—Ly T. Tran

(57) ABSTRACT

An ink jet printer has a printhead with ink droplet ejecting nozzles that moves in a two dimensional direction across a movable recording medium or intermediate surface. The recording medium or intermediate surface is moved in a first direction with a constant velocity. The printhead is spaced from and is parallel to the recording medium or intermediate surface during the two dimensional movement of the printhead. During the printing process, the printhead is moved concurrently in the first direction at a velocity equal to the velocity of the recording medium or intermediate surface and in a second direction that is perpendicular to the first direction. This two dimensional movement of the printhead causes the ink droplets ejected therefrom to print swaths of information across the recording medium or intermediate surface that are perpendicular to the first direction.

20 Claims, 13 Drawing Sheets

INK JET PRINTHEAD HAVING TWO DIMENSIONAL SHUTTLE ARCHITECTURE

BACKGROUND

An exemplary embodiment of this application relates to an ink jet printer having a shuttling printhead that ejects droplets of either melted solid ink or liquid ink onto a moving recording medium or intermediate surface to print swaths of information that are perpendicular to the direction of movement thereof. More particularly, the exemplary embodiment relates to an ink jet printer having a two-dimensionally movable printhead that prints swaths of information on a recording medium or intermediate surface that moves at a constant velocity. The printed swaths of information are perpendicular to the moving direction of the recording medium or intermediate surface. A transfixing station may be located downstream from the printhead whereat the printed information on the intermediate surface may be transferred and fixed to a recording medium.

Droplet-on-demand ink jet printing systems eject ink droplets from printhead nozzles in response to pressure pulses generated within the printhead by either piezoelectric devices or thermal transducers, such as resistors. The ejected ink droplets are propelled to specific locations on a recording medium, commonly referred to as pixels, where each ink droplet forms a spot on the recording medium. The printheads contain ink in a plurality of channels, usually one channel for each nozzle, which interconnect an ink reservoir in the printhead with the nozzles.

In a thermal ink jet printing system, the pressure pulse is produced by applying an electrical current pulse to a resistor typically associated with each one of the channels. Each resistor is individually addressable to heat and momentarily vaporize the aqueous based ink in contact therewith. As a voltage pulse is applied across a selected resistor, a temporary vapor bubble grows and collapses in the associated channel, thereby displacing a quantity of ink from the channel, so that it bulges through the channel nozzle. The ink bulging through the nozzle is ejected from the nozzle as a droplet, during the bubble collapse on the resistor. The ejected droplet is then propelled to a recording medium. When the ink droplet hits the targeted pixel on the recording medium, the ink droplet forms a spot thereon. The channel from which the ink droplet was ejected is then refilled by capillary action, which, in turn, draws ink from an ink supply container.

In a typical piezoelectric ink jet printing system, the pressure pulses that eject liquid ink droplets are produced by applying an electric pulse to the piezoelectric devices, one of which is typically located within each one of the ink channels. Each piezoelectric device is individually addressable to cause it to bend or deform and pressurize the volume of liquid ink in contact therewith. As a voltage pulse is applied to a selected piezoelectric device, a quantity of ink is displaced from the ink channel and a droplet of ink is mechanically ejected from the nozzle associated with each piezoelectric device. Just as in thermal ink jet printing, the ejected droplet is propelled to a pixel target on a recording medium. The channel from which the ink droplet was ejected is refilled by capillary action from an ink supply. For an example of a piezoelectric ink jet printer, refer to U.S. Pat. No. 3,946,398.

The majority of color printers today use an aqueous ink in a thermal ink jet printer. If a shuttling printhead is used, the printhead is transported across a stationary recording medium, such as a sheet of paper, from one edge thereof to the opposite edge. This is usually referred to as the "X" or scan direction. Once the printhead has been transported in the X direction across the recording medium, either the recording medium or the printhead is advanced a distance of the height of a printed swath or a portion thereof in the direction perpendicular to the X direction usually referred to as the "Y" direction. The printhead is then scanned in the X direction back across the recording medium to the original edge thereof, so that another swath of information is printed. The subsequently printed swaths may be contiguous with the previously printed swaths or interlaced therewith. When the complete image is printed on the recording medium, it is removed and replaced with a clean recording medium and the process is repeated for a subsequent image.

An ink jet printhead can include one or more printhead die assemblies, each having a droplet ejecting portion and a channel portion. The channel portion includes an array of ink channels that bring ink into contact with the droplet ejectors, which are correspondingly arranged on the droplet ejecting portion. In addition, the droplet ejecting portion may also have integrated addressing electronics and driver transistors. The array of channels in a single die assembly is not sufficient to cover the full width of a page of recording medium, such as, for example, a standard sheet of paper. Therefore, a printhead having only one die assembly is scanned across the page of recording medium while the recording medium is held stationary and then the recording medium is advanced between scans. Alternatively, multiple die assemblies may be butted together to produce a full width printhead, such as, for example, the printhead disclosed in U.S. Pat. Nos. 4,829,324 and 5,221,397.

Because thermal ink jet printhead nozzles typically eject ink droplets that produce spots of a single size on the recording medium, high quality printing requires the ink channels and associated nozzles and corresponding printhead droplet ejectors to be fabricated at a high resolution, such as, for example, 600 per inch.

The ink jet printhead may be incorporated into a carriage type printer or a full width array type printer. The carriage type printer may have a printhead having a single die assembly or several die assemblies abutted together for a partial width size printhead. Since both single die and multiple-die, partial width printheads function substantially the same way in a carriage type printer, only the printer with a single die printhead will be discussed. The only difference, of course, is that the partial width size printhead will print a larger swath of information. The single die printhead, containing the ink channels and nozzles, can be connected to an ink supply attached thereto or located separately therefrom. The printhead is reciprocated to print one swath of information at a time, while the recording medium is held stationary. Each swath of information is equal to the height of the column of nozzles in the printhead. After a swath is printed, the recording medium is stepped a distance at most equal to the height of the printed swath, so that the next printed swath is contiguous or overlaps with the previously printed swath. When the subsequently printed swath is overlapped or partially overlapped with the previously printed swath, the printed spots or pixels may be interlaced to increase image resolution. This procedure is repeated until the entire image is printed. If the printhead is shuttled across the recording medium, the recording medium is held stationary until the complete image is printed. The printhead is scanned first in the X direction during which time it prints a swath of information and then is stepped in the Y direction without ejecting ink droplets prior to the next scan in the X direction.

In contrast, the page width printer includes a stationary printhead having a length sufficient to print across the width of sheet of recording medium. The recording medium is continually moved past the full width printhead in a direction substantially normal to the printhead length and at a constant or varying speed during the printing process. Another example of a full width array printer is described, for example, in U.S. Pat. No. 5,192,959.

Ink jet printing systems typically eject ink droplets based on information received from an information output device, such as, a personal computer. Typically, this received information is in the form of a raster, such as, for example, a full page bitmap or in the form of an image written in a page description language. The raster includes a series of scan lines comprising bits representing individual information elements or pixels. Each scan line contains information sufficient to eject a single line of ink droplets across the recording medium in a linear fashion from one nozzle. For example, ink jet printers can print bitmap information as received or can print an image written in the page description language once it is converted to a bitmap of pixel information.

The problem of ink drying time and paper cockling are widely recognized issues when printing high coverage areas with aqueous based inks, particularly when printing color images. The problem of drying time and paper cockling is substantially reduced when solid ink is used and the printhead ejects droplets of melted ink onto the recording medium, where the melted ink droplets solidify immediately. Further improvement in the drying time and cockling problem is obtained when the printhead ejects droplets of melted ink onto an intermediate surface, such as, for example, a drum, that has a release agent coating thereon. Once the image is fully formed on the intermediate surface, the image is then transferred to a recording medium, such as paper. The transfer is generally conducted in a nip formed by the rotating intermediate belt or drum surface and a rotatable heated pressure roll. As a sheet of paper is transported through the nip, the fully formed image is transferred from the intermediate belt or drum surface to the sheet of paper and concurrently fixed thereon. This transfer technique of using the combination of heat and pressure at a nip to transfer and fix the image to a recording medium passing through the nip is usually referred to as "transfixing," a well known technology.

In all of the above mentioned current ink jet printers, there is a loss of efficiency induced by time spent during which the printhead does not eject ink droplets. In a shuttle printhead architecture, this time is spent while decelerating and accelerating the printhead as it turns around between scans. In the intermediate drum configuration, this time is spent as the printhead passes over inter image spaces or dead bands, and also during the time that transfixing occurs. To minimize this unused time, reduction in the time spent transfixing has been the goal, but transfixing speeds of 25 inches per second or higher has been found not to produce prints with an appropriate level of print quality and durability. One solution is to use a separate off line transfixing step, but this results in added costs, complexity and reliability issues for the printer system. In addition to the transfixing time, the intermediate drum surface must be re-coated with a release agent between prints, resulting in further time being spent while the printhead is not printing. In current ink jet printers using intermediate transfer members, the transfixing process must be performed serially after the imaging process. As printer speeds increase, the time required for the transfixing process must get shorter, forcing the transfixing process to higher speeds, causing degraded image quality.

U.S. Pat. No. 5,099,256 discloses a thermal ink jet printer having a translatable multicolor printhead and a rotatable intermediate drum with a film forming silicone polymer layer on the outer surface thereof. The drum surface is heated to dehydrate the aqueous based ink droplets deposited thereon from the printhead at a first location. The drum is rotated and the dehydrated droplets are transferred from the drum to a recording medium at a transfer station positioned adjacent the drum at a second location.

U.S. Pat. No. 6,033,053 discloses an ink jet printing cartridge in the form of a cylindrical drum having a plurality of individual printheads helically formed on and covering the outer surface of the drum. The drum is rotated about its axis, and as the drum is rotated, the printheads confronting a sheet of paper are actuated to eject ink droplets, while the sheet of paper is moved past the rotating drum shaped cartridge.

U.S. Pat. No. 6,394,577 discloses an ink jet printing apparatus for forming an ink image on a receiver or recording medium that is attached to the surface of a rotatable drum. The drum is rotated about its axis, and the printing apparatus has an ink jet printhead that is movable in a direction parallel to the drum axis and ejects ink droplets onto the receiver while the drum is rotated at a predetermined velocity. The printing apparatus moves the printhead at a velocity less than that of the drum, so that the printhead scans an area of the drum surface that is skewed relative to the drum surface. Control circuitry simultaneously controls the movement of the drum and printhead and actuates the printhead to form an ink image within the skewed scans, but only within the boundaries of the receiver.

U.S. Pat. No. 6,511,172 discloses an ink jet printing apparatus having a flat transport belt for transporting a printing sheet to a region opposite the ejection openings of the printheads. An electrostatic generating means provides an electrostatic suction or attraction force on the surface of the transport belt. A control means generates the attraction force only in a region opposite the printheads.

U.S. Pat. No. 6,588,877 discloses a bi-directional envelope printing system having a reciprocating carriage that moves from a maintenance station in a first direction across a printing location to an end position. The carriage then returns across the printing location to the maintenance station. The carriage includes multiple ink jet printheads, each printing a swath of information that has a specific swath height. The printheads print on a first envelope while traveling in the first direction, and the printheads print on a second envelope on the return trip to the maintenance station. An envelope transport delivers each envelope to the printing location and removes the printed envelope prior to delivery of the subsequent envelope to be printed.

SUMMARY

It is an object of an exemplary embodiment of this application to provide an ink jet printer having either a transporting surface carrying a recording medium or an intermediate surface that moves at a constant velocity and a two-dimensional shuttling printhead that ejects ink droplets directly on the recording medium or the intermediate surface. During back and forth scans across the recording medium or intermediate surface, the two dimensionally moving printhead prints swaths of information that are perpendicular to the moving direction of the recording medium or intermediate surface. For a printer having an intermediate surface, the swaths of information may be printed at one location on the intermediate surface, while the previously printed swaths may be concurrently transfixed onto a recording medium at a second location without interruption of the intermediate surface movement.

In one aspect of the exemplary embodiment, there is provided an ink jet printer that includes an intermediate receiving surface movable in a first direction at a constant velocity past a printing zone and then past a transfixing station. A two dimensionally translating printhead is located adjacent the printing zone. The printhead translates back and forth across the intermediate surface in a second and third direction, both of which are perpendicular to the first direction, and concurrently moves in the first direction at the same velocity as the intermediate surface during each transit across the intermediate surface. This printhead motion chases the intermediate surface to maintain zero relative movement therebetween during printing and forms printed swaths that are perpendicular to the intermediate surface direction of motion. The second and third directions of the printhead are directly opposite each other, so that when the printhead travels in the second direction and concurrently in the first direction, one swath is printed across the intermediate surface. Then, the printhead reverses itself and travels in the third direction and concurrently in the first direction to print another swath parallel to the first swath. The back and forth translation of the printhead continues until the full image is completed. As the printed swaths on the intermediate surface enter the transfixing station, the printed image is transfixed to a recording medium at a constant rate without interruption of the printhead.

In one embodiment, there is provided an ink jet printer having a two dimensional shuttle architecture, comprising a movable receiving member having opposing edges and being moved in a first direction at a constant velocity; a movable printhead having at least one array of ink droplet ejecting nozzles, said array of nozzles being spaced from and substantially parallel to said receiving member, said printhead ejecting ink droplets from said array of nozzles onto said receiving member while said receiving member is being moved in said first direction; and means for shuttling said printhead back and forth across said receiving member between said opposing edges thereof concurrently in both said first direction and a second direction, said second direction being substantially perpendicular to said first direction, movement of said printhead in said first direction being at a velocity equal to said constant velocity of said receiving member, so that said ink droplets ejected from said array of nozzles in said printhead print parallel swaths of information across said receiving member that are substantially perpendicular to said first direction each time said printhead traverses across said receiving member.

In another embodiment, there is provided a method of printing with an ink jet printer having a two dimensional shuttle architecture, comprising the steps of moving a recording surface having opposing edges in a first direction at a constant velocity; providing a movable printhead having at least one array of ink droplet ejecting nozzles that confronts and is substantially parallel to said recording surface; shuttling said printhead during printing concurrently in said first direction at a velocity equal to said constant velocity of said recording surface and in a second direction across said recording surface and between the opposing edges thereof, said second direction being substantially perpendicular to said first direction; and ejecting ink droplets from said printhead nozzles onto said moving recording surface during said concurrent movement by said printhead in said first and second directions, said printhead printing a swath of information having a predetermined height each time said printhead is shuttled across said recording surface from one edge thereof to the other end, whereby said printed swaths of information are parallel to each other and perpendicular to said first direction.

BRIEF DESCRIPTION OF THE DRAWINGS

An exemplary embodiment of this application will now be described, by way of example, with reference to the accompanying drawings, in which like reference numerals refer to like elements, and in which.

DESCRIPTION OF THE PREFERRED EMBODIMENT

Figure 1:
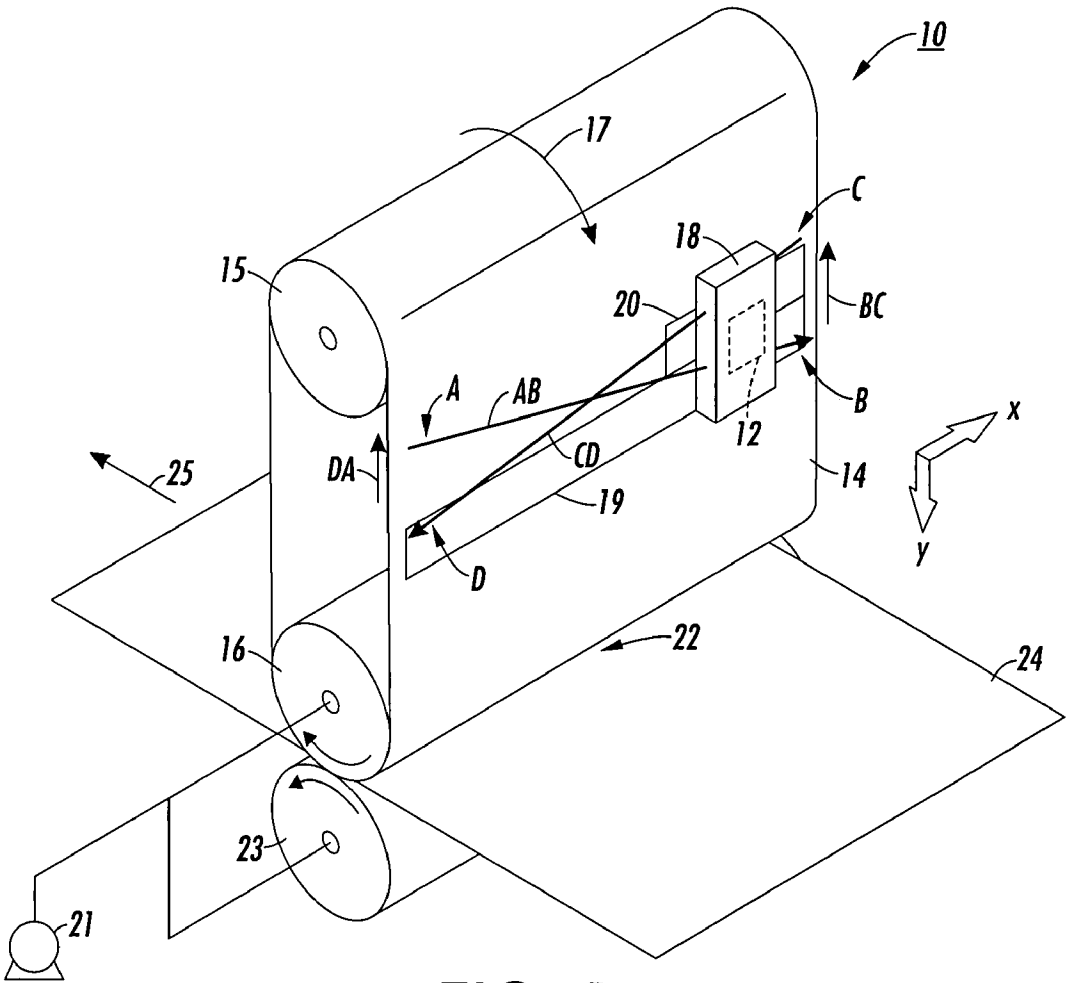
FIG. 1 is a schematic isometric view of an ink jet printer having a rotatable intermediate recording belt member, two dimensionally moving printhead, and transfixing station according to an exemplary embodiment of this application, the two dimensional movement of the printhead being conceptually depicted by arrows.

In FIG. 1, a schematic representation of an ink jet printer 10 incorporating an exemplary embodiment of this application is shown in an isometric view. The ink jet printer 10 employs a two dimensionally moving printhead 12, shown in dashed line, that has at least one array of nozzles (not shown) confronting but spaced from a rotatably mounted intermediate belt 14. The intermediate belt is rotated at a constant velocity about idler roll 15 and driven roll 16 in the direction of arrow 17. The printhead 12 is mounted on a carriage 18 that carries the printhead back and forth across a span of the intermediate belt. The carriage moves the printhead in the X direction, and concurrently moves the printhead in the same direction as the intermediate belt or Y direction in a cycle indicated by arrows AB, BC, CD, and DA, as explained later. The motion in the Y direction causes the printhead to "chase the intermediate belt" as it moves during the printing process, thereby providing zero relative motion between the printhead and the intermediate belt in the Y direction. This allows the printhead to print parallel swaths of information that are perpendicular to the direction of the intermediate belt. The parallel swaths may be contiguous or overlapping.

Referring to FIG. 1, the carriage 18 with printhead 12 is transported from location A to location B in the direction of arrow AB. The velocity of the printhead is sufficient to enable ink droplets (not shown) ejected from the printhead 12 to print swath 19 on the intermediate belt that is perpendicular to the moving direction 17 of the intermediate belt. As soon as the carriage arrives at location B, the carriage is quickly moved in a direction opposite to the direction of movement of the intermediate belt to location C during which time no ink droplets are ejected, as indicated by arrow BC. The carriage is then transported across the intermediate belt from location C to location D, as indicated by arrow CD. During the travel of the carriage in the direction of arrow CD, ink droplets are ejected from the printhead to print swath 20 that is parallel to swath 19. Upon arrival of the carriage at location D, the carriage is again quickly moved in a direction opposite to the movement of the intermediate belt to location A, as indicated by arrow DA, during which time no ink droplets are ejected. This movement from location A through location and return to location A completes one cycle of back and forth travel across the intermediate belt. This cycling of the printhead in two-dimensional directions back and forth across the intermediate belt is continued until the complete image is printed.

The printhead 12 ejects ink droplets onto the intermediate belt 14 one swath for each traverse thereof. The driven roll 16 is rotated at a constant velocity by an electric motor 21 that is capable of precise motion quality. The intermediate belt 14 may function as a transport for a recording medium (not shown) that is held thereon by any suitable means, such as, for example, electrostatic attraction, so that the two dimensionally moving printhead 12 may print directly on the recording medium. Such an embodiment is discussed later with respect to FIG. 4. In the embodiment of FIG. 1, the two dimensionally moving printhead prints on the intermediate belt and the printed information is subsequently transferred to a recording medium 24 at a transfixing station 22. A transfixing station 22 comprises a nip formed between the driven roll 16 and a heated pressure roll 23 that sandwiches the intermediate belt therebetween. The pressure roll 23 may be driven by electric motor 21 or a separate motor, not shown. A recording medium 24 is transported through the transfixing nip 22 in the direction of arrow 25 at a constant velocity and is sandwiched between the intermediate belt and the pressure roll. The recording medium is transported through the transfixing nip in a timed and registered manner with the printed image swaths on the intermediate belt, and the printed images are transfixed to the recording medium. As is well known in the industry, transfixed means the printed images are transferred to and fixed or fused to the recording medium by the heat and pressure applied to the printed image at the nip.

Any transporting apparatus that can suitably shuttle the printhead 12 back and forth across a moving intermediate receiving member in both the X direction and to a smaller extent in the Y direction concurrently will suffice, so long as the swaths of information printed on the intermediate member are perpendicular to the moving direction of the intermediate member, while the intermediate member is moving at a constant velocity. In addition, the printed information on the intermediate member must be subsequently transfixed to a recording medium at a transfixing station without interrupting the movement of the intermediate member.

Figure 2:
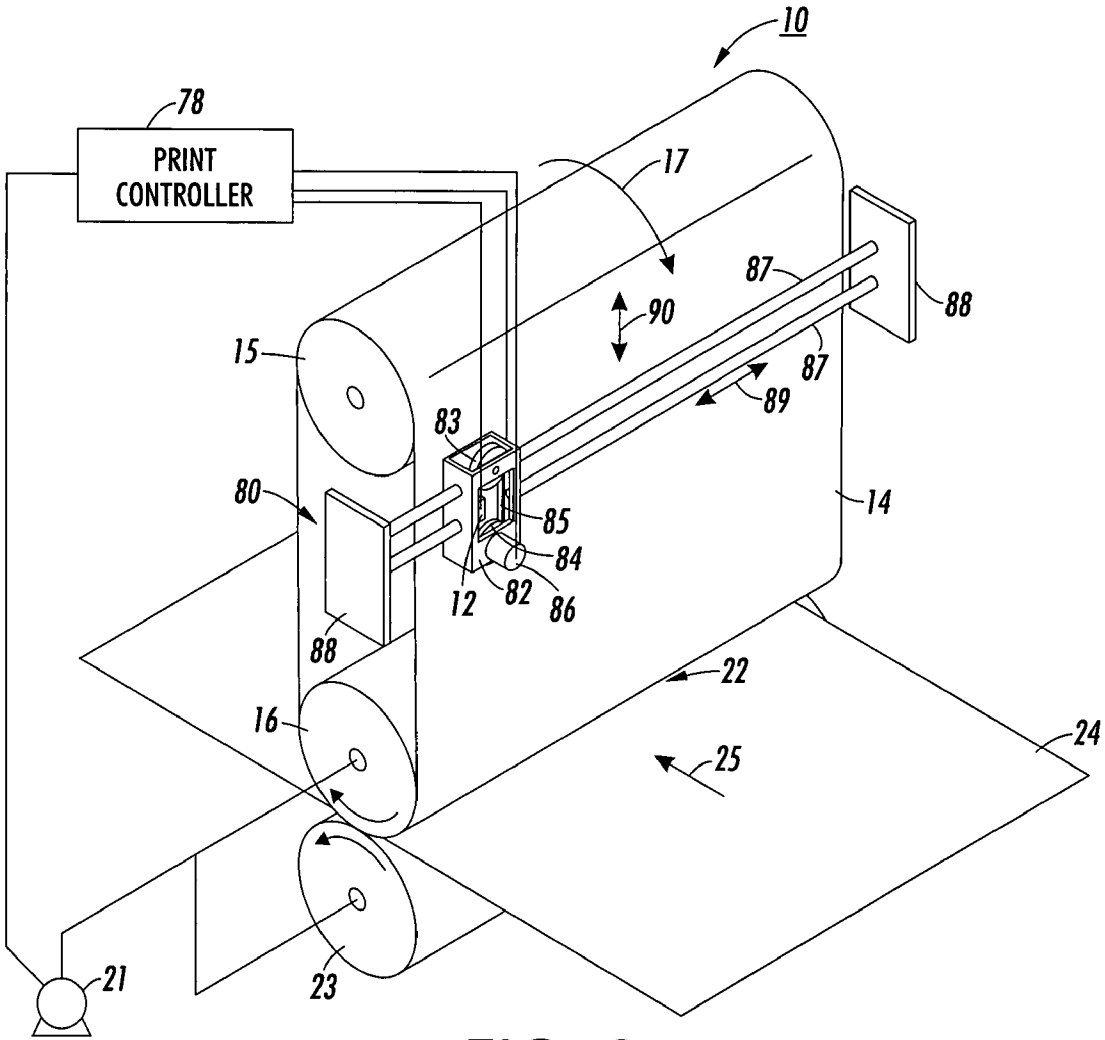
FIG. 2 is an isometric view of the printer shown in FIG. 1, including an exemplary guiding apparatus that transports the two dimensionally moving printhead back and forth across the intermediate belt member in one direction.
Figure 3:
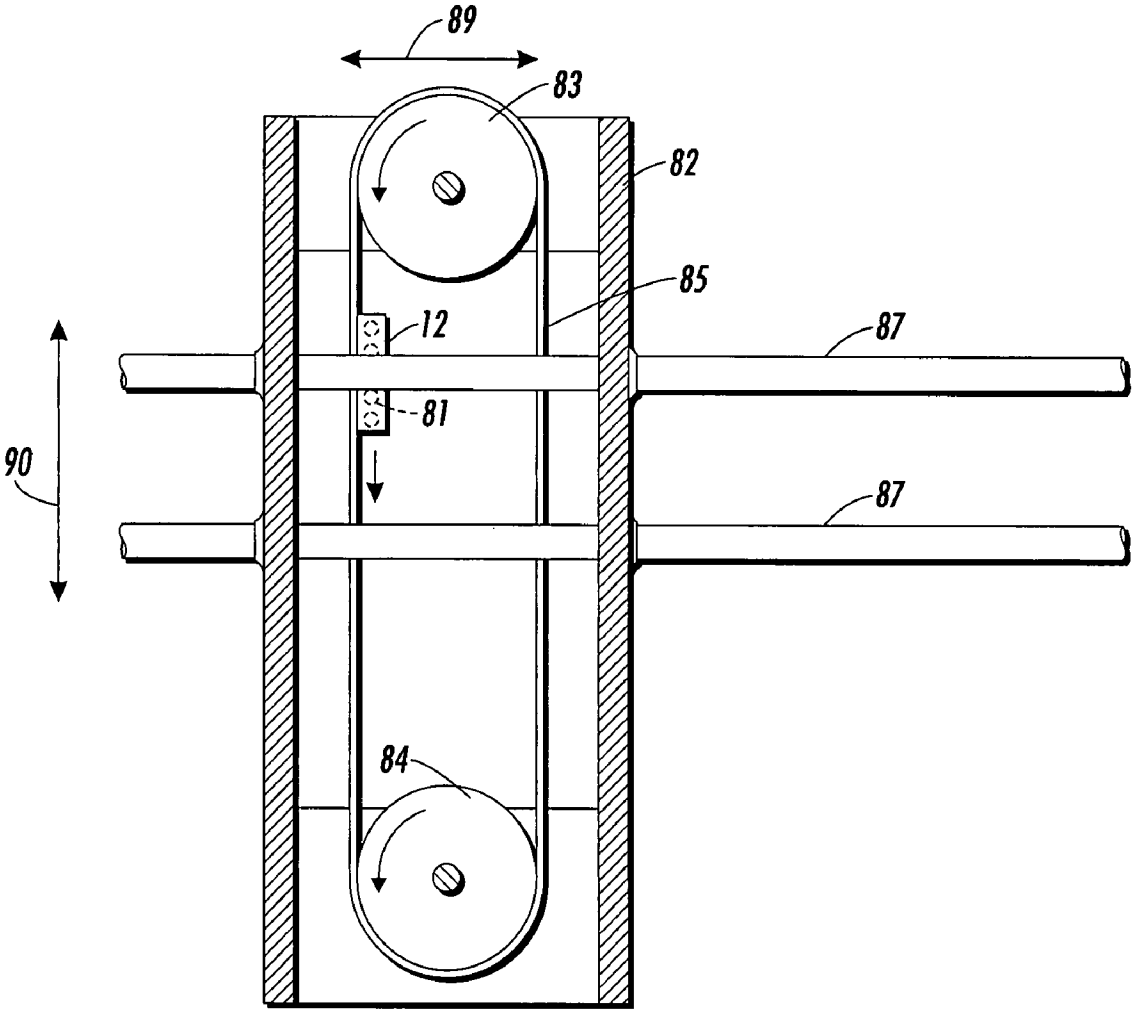
FIG. 3 is an enlarged elevation view of the guiding apparatus showing the carriage and printhead mounted thereon in more detail.

One suitable embodiment of an exemplary guiding apparatus for the printhead is shown in FIGS. 2 and 3. Referring to FIG. 2, an isometric view of the ink jet printer 10, similar to the view in FIG. 1, incorporates an exemplary guiding apparatus 80 capable of transporting the two-dimensionally movable printhead 12 in carriage 82. Carriage 82 is translated back and forth across the intermediate belt 14 in the X direction on stationary guide rails 87. The guide rails 87 are mounted in fixed frame members 88. The carriage may be translated by any suitable means, such as, for example, by a cable and a pair of pulleys (not shown), one pulley of which would be reversibly driven.

A pair of pulleys 83,84 are rotably mounted in carriage 82 and has a timing belt 85 entrained therearound. Pulley 84 is driven by a reversible electric motor 86. The pulleys are arranged so that the spans of timing belt therebetween are parallel to the direction of movement of the intermediate belt 14. The printhead 12 has an array of nozzles 81, shown in dashed line in FIG. 3, and is attached to one span of the timing belt 85. The array of nozzles is also parallel to the moving direction of the intermediate belt after the printhead is attached to the timing belt. As the carriage 82 moves in the X direction, as indicated by arrow 89, the printhead 12 is moved by means of the timing belt 85 in the Y direction, as indicated by arrow 90. At the beginning of printing of each swath of information, the printhead is located adjacent upper pulley 83 and is moved toward pulley 84. The reversible electric motor 86 moves the printhead 12 at the same velocity as the intermediate belt 14 is moved, while the carriage 82 is concurrently translated across the intermediate belt in the X direction. The relative speeds of the carriage and printhead is such that the carriage moves across the intermediate belt and arrives at the opposite edge thereof at substantially the same time the printhead arrives at a location adjacent pulley 84. Thus, the printhead is moved concurrently in two dimensions or directions and prints a swath of information on the intermediate belt for each translation of the carriage. Because the printhead maintains zero relative movement with respect to the intermediate belt as the carriage is translated in the X direction while printing, the swaths of information are perpendicular to the Y direction or moving direction of the intermediate belt.

Once the carriage 82 has translated the printhead 12 from one edge of the intermediate belt to the other, the carriage reverses its direction. Each time a swath of information has been completed and immediately prior to the translation direction of the carriage being reversed, the reversible electric motor 86 reverses its driving direction and rapidly returns the printhead to the location adjacent pulley 83. While the printhead is being returned to the location adjacent pulley 83, the printhead does not eject ink droplets. As soon as the printhead is positioned adjacent pulley 83, the reversible electric motor is ready to once again move the printhead in the Y direction and at the same velocity as that of the intermediate belt. As the carriage begins the translation back across the intermediate belt to the opposite edge thereof in the reverse X direction, the printhead is moved in the Y direction to print another swath of information perpendicular to the moving direction of the intermediate belt or X direction. Thus, the printhead is moved concurrently in two directions as it travels across the intermediate belt ejecting ink droplets and printing swaths of information that are perpendicular to the Y direction. The movement of the printer components, including those of the guiding apparatus 80, is controlled by the printer controller 78. Another advantage of this embodiment of printer 10 is that the intermediate belt may move at a constant velocity without interruption during the printing operations.

While the printhead 12 continues to print swaths of information on the intermediate belt, the previously printed swaths of information approach the transfixing station defined by the nip 22 formed between the portion of intermediate belt 14 wrapped around driven roll 16 and the heated pressure roll 23. The swaths of information or image on the intermediate belt will be transfixed to the recording medium 24 as it is transported through the transfixing station nip 22 in the direction of arrow 25.

Referring to FIG. 3, an enlarged elevation view of the carriage 82 is shown with a portion removed to show the printhead 12 attached to the timing belt 85. The timing belt 85 is entrained on pulleys 83,84 that are rotably mounted in the carriage and oriented so that the spans of timing belt between the pulleys are parallel to the direction of movement of the intermediate belt; viz., the Y direction. Also shown is the array of nozzles 81 in the printhead 12, shown in dashed line, that is substantially parallel to the Y direction, as indicated by arrow 90 and substantially perpendicular to the X direction, as indicated by arrow 89.

Figure 4:
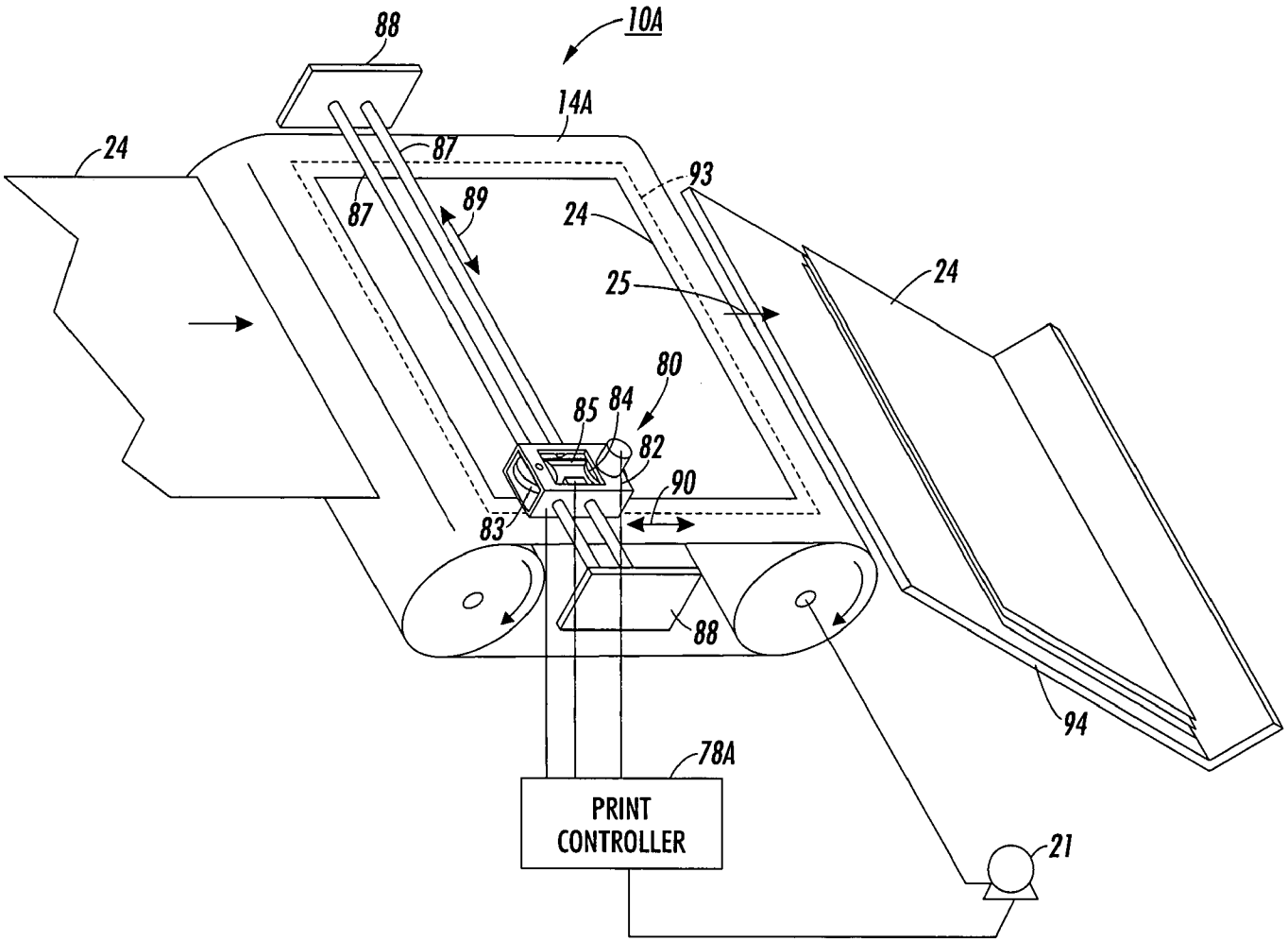
FIG. 4 is an isometric view of a printer utilizing the two dimensionally movable printhead of the exemplary embodiment of this application to print directly on a recording medium.

In FIG. 4, an isometric view of the ink jet printer 10A is shown. In this view, the two dimensionally movable printhead 12 ejects ink droplets (not shown) directly on the recording medium 24. The guiding apparatus 80 for moving the two dimensionally movable printhead is identical with that disclosed above with respect to FIG. 2. Instead of an intermediate belt, transport belt 14A is mounted on idler roll 15 and driven roll 16. The transport belt is driven at a constant velocity by electric motor 21 and transports a recording medium 24 thereon past the guiding apparatus 80 that controls the movement of the printhead 12. In this configuration, the transport belt may be porous or perforated so that a vacuum source (not shown) may be located beneath the transport belt and used to hold the recording medium thereon. Alternatively, a solid transport belt may be used and the recording medium held thereon by electrostatic attraction in accordance with well known procedure. The transport belt is oriented in the horizontal direction with the guiding apparatus directly thereover, so that the ink droplets that are ejected from the printhead 12 follow a downward trajectory that is normal the recording medium on the transport belt.

The printed recording mediums are directed off the transport belt and stacked on a collection tray 94. Fresh recording mediums are serially positioned on the transport belt and held in place by any suitable means, such as mentioned above. The transport belt moves the recording medium past guiding apparatus 80, and the guiding apparatus moves the printhead 12 in a two dimensional direction, so that the printhead prints swaths of information that are perpendicular to the direction of movement of the transport belt or Y direction.

There are several printing applications in which it may be more efficient to move the printhead in the two dimensions and print directly on an object or substrate. This enables the marked object or substrate to move at a constant velocity, rather than being advanced stepwise with each pass or traversal of the printhead. For example, printing on heavy materials, such as doors, metal plates, circuit boards, and other materials that are more massive than paper. The more massive the object to be printed, the more challenging the task of acceleration and deceleration of the object on the transport belt. It would clearly be more efficient and practical to move the object or substrate at a constant velocity enabled by the exemplary embodiment of this application.

Even printing directly on a recording medium such as paper may benefit from the use of a two dimensionally movable printhead that prints on a continually moving transport member at a constant velocity, if some form of post process is used. For example, using aqueous ink on plain paper will leave the paper wet for high-density images and a heater in the downstream paper path to dry the ink would be beneficial before the printed paper leaves the printer. Such an embodiment would enable the paper to move at a constant velocity through the printer and achieve high productivity.

Figure 5:
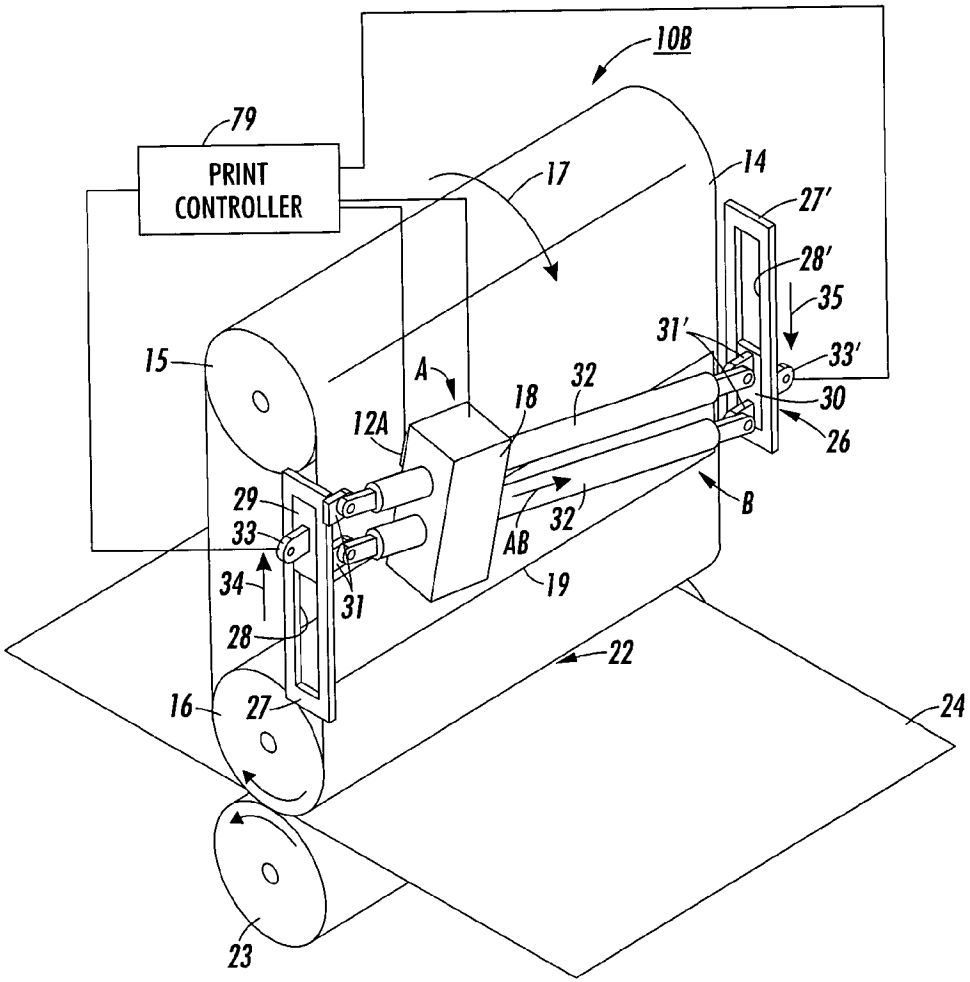
FIG. 5 is an isometric view of the printer shown in FIG. 1, depicting another exemplary guiding apparatus for transporting the two dimensionally moving printhead across the intermediate belt member in one direction.
Figure 6:
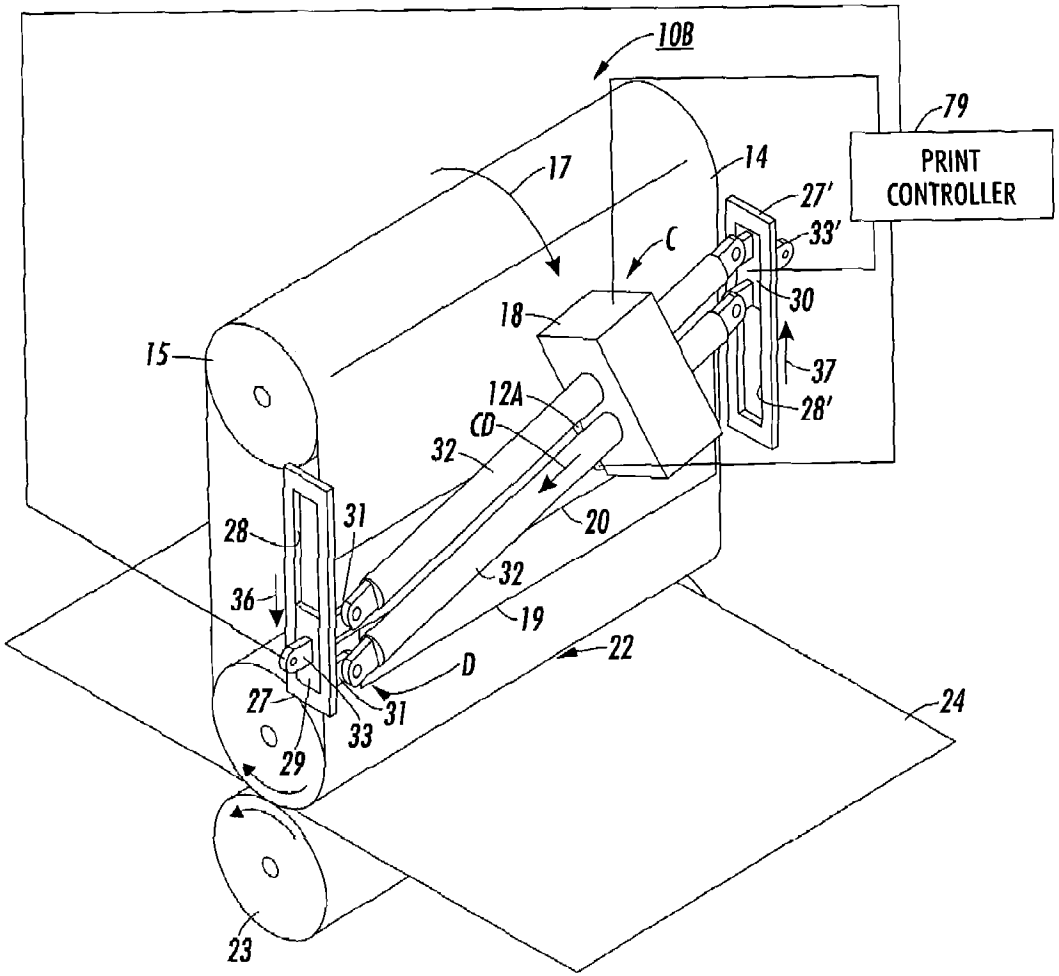
FIG. 6 is an isometric view of the printer shown in FIG. 5, depicting the exemplary guiding apparatus therein transporting the two dimensionally moving printhead across the intermediate belt member in a direction opposite to the direction shown in FIG. 5.

Another suitable embodiment of an exemplary guiding apparatus is described with respect to FIGS. 5 and 6. Referring to FIG. 5, an isometric view of the ink jet printer 10B, similar to the view shown in FIG. 1, incorporates an exemplary guiding apparatus 26 capable of transporting the two dimensionally movable printhead 12A on carriage 18 in the cycling manner discussed with respect to FIG. 1. A guide member 27,27' is fixedly mounted on opposing sides of the intermediate belt. The guide members are parallel to each other and the direction of movement of intermediate belt. The guide members have slots 28,28' that are parallel to each other and contain slide members 29,30 therein. Each slide member has two integrally formed extensions 31,31' that extend from the slide member in a direction inwardly toward each other, and an integrally formed ear 33,33' that extends outwardly in opposite directions from each other. Two guide rails 32 are each pivotally attached at each end to one of the extensions 31,31' on each of the slide members 29,30. The carriage 18 is slidably mounted on the two guide rails and moved back and forth along the guide rails by any suitable means (not shown) mounted between the slide members, such as, for example, by pulley and cable or timing belt in a manner well in the industry.

Figure 5A:
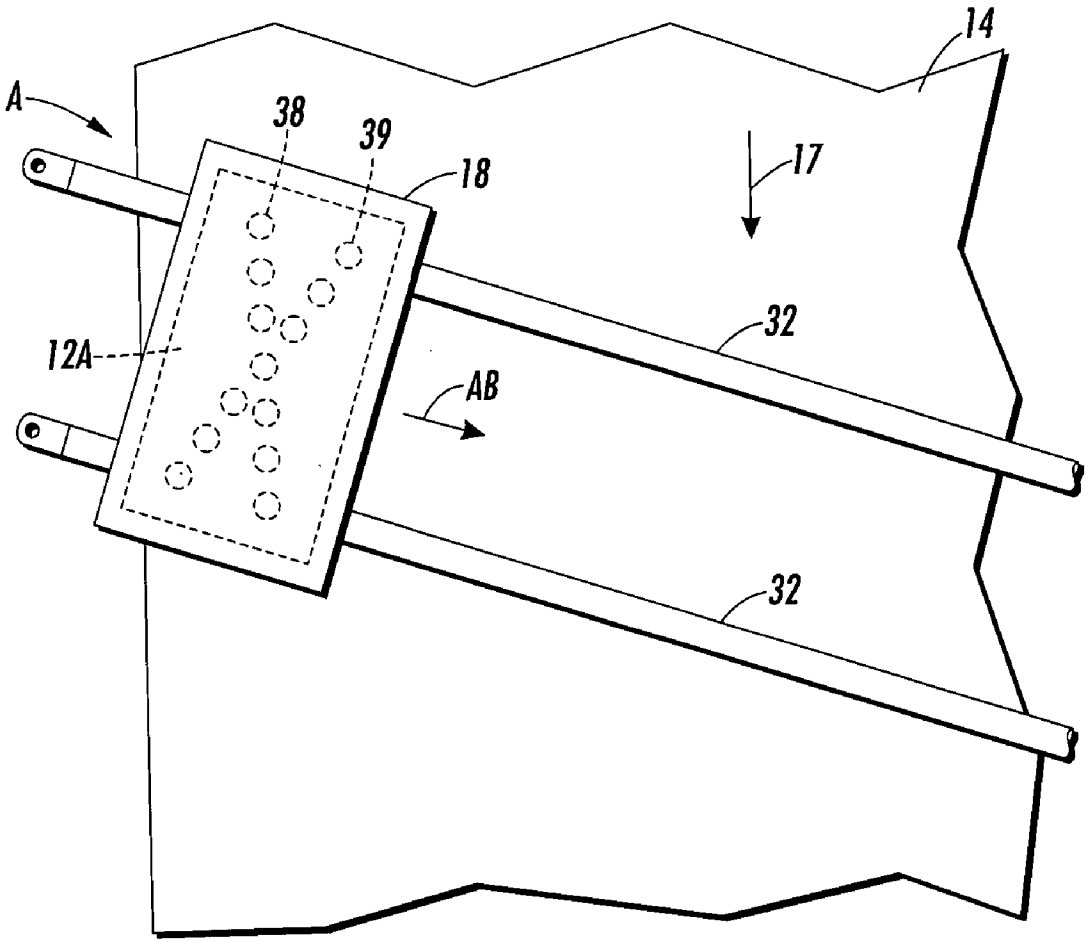
FIG. 5A is an enlarged, partially shown elevation view of FIG. 5, showing the printhead with two arrays of nozzles in dashed line, one array being parallel to the direction of movement of the intermediate belt member and only the parallel array being used to print in the direction indicated.
Figure 6A:
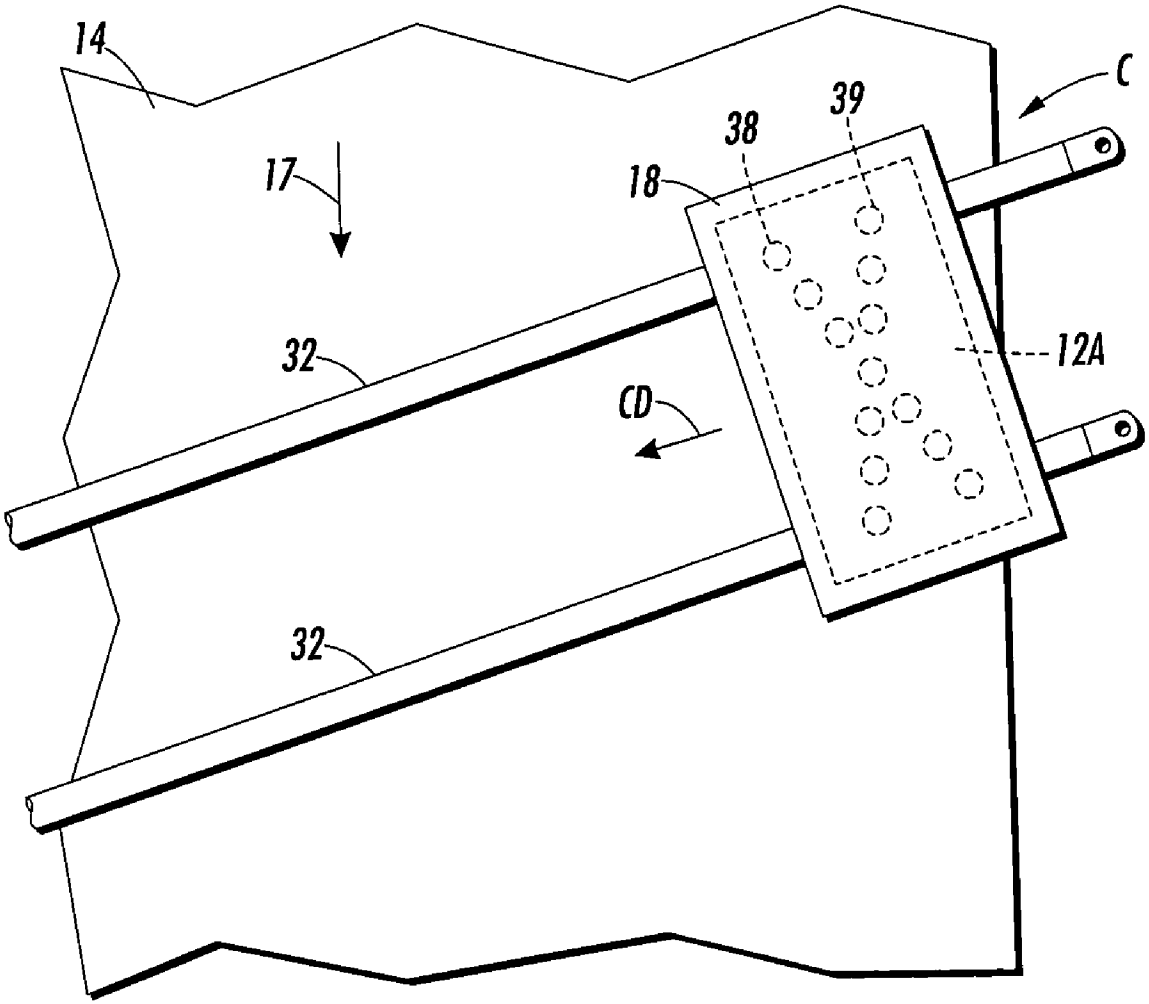
FIG. 6A is an enlarged, partially shown elevation view of FIG. 6 showing the printhead with two arrays of nozzles in dashed line, the other array being parallel to the direction of movement of the intermediate belt member and only the parallel array being used to print in the direction indicated.

In FIG. 5, the slide member 29 is shown in an upper location in slot 28 of guide member 27, while the slide member 30 is shown in a lower location in slot 28' of guide member 27'. This causes the guide rails to be diagonal across the width of the intermediate belt. The carriage 18 with printhead 12A is shown at location A and is being transported along the guide rails 32 in the direction of arrow AB toward location B. Referring also to FIG. 5A, where an enlarged, partially shown view of FIG. 5 is depicted, a schematic representation of the printhead 12A is indicated in dashed line with two arrays of nozzles 38,39, also in dashed line. Nozzle array 38 has at least one column of nozzles that is parallel to the direction of movement of the intermediate belt 14, when the carriage 18 moves in the direction of arrow AB. Nozzle array 39 has at least one column of nozzles that is parallel to the direction of movement of the intermediate belt, when the carriage 18 moves in the direction of arrow CD, as seen in FIG. 6A. The printhead 12A may contain both nozzle arrays 38,39, as shown in this embodiment, or the nozzle arrays may be in separate, adjacent printheads (not shown).

In this embodiment, the two nozzle arrays 38,39 cross each other to form an "X" shape. However, other relative positions may be used so long as nozzle array 38 prints swaths of information that are perpendicular to the direction of movement of the intermediate belt, when the carriage travels in the direction of arrow AB and nozzle array 39 prints swaths of information that are also perpendicular to the direction of the intermediate belt, when the carriage travels in the direction of arrow CD.

As shown in FIG. 5, the printhead 12A is beginning to print a swath of information above and parallel to a previously printed swath 19 by ejecting ink droplets from nozzle array 38 as it moves in the direction of arrow AB. The slide members 29,30 are directed along slots 28,28' of the slide members 29,30 to their respective upper and lower locations, as indicated by arrows 34,35. The slide members may be positioned by any suitable means, such as, for example, solenoids (not shown), that are connected to the ears 33,33' of the slide members. The slide members are held in these locations until the printhead has reached location B, at which time the means for positioning the slide members quickly move the slide members to their respective opposite locations in the slots 28,28' of the guide members 27,27', as shown in FIG. 6. The printhead does not print during movement of the slide members.

FIG. 6 is the same as FIG. 5, except the slide members 29,30 have been reversed to opposite locations in the respective guide member slots 28,28' as indicated by arrows 36,37. In FIG. 6, slide member 29 is positioned in a lower location in guide member slot 28 and slide member 30 is positioned in an upper location in guide member slot 28'. The carriage 18 with printhead 12A is positioned at location C, and the carriage is being moved in the direction of arrow CD toward location D. Referring also to FIG. 6A, an enlarged, partially shown view of FIG. 6 is depicted, wherein a schematic representation of the printhead 12A is shown that is similar to FIG. 5A. Nozzle array 39 has at least one column of nozzles that is parallel to the direction of movement of the intermediate belt 14, when the carriage 18 moves in the direction of arrow CD.

During the traverse from location C to location D, the printhead ejects ink droplets from nozzle array 39 to print another swath of information parallel to previously printed swaths 19,20. Meanwhile, the previously printed swaths 19,20 approach the transfixing nip 22 where the swaths of image on the intermediate belt will be transfixed to the recording medium 24 that is being transported through the nip 22. Once the carriage 18 reaches location D, the slide members 29,30 are immediately returned to their locations as shown in FIG. 5 to complete one back and forth cycle across the intermediate belt. Again, the printhead does not print during the rapid movement of the slide members 29,30. The back and forth cycling of the carriage with the printhead continues until the image has been completely printed on the intermediate belt 14. The movement of the carriage 18, slide members 29,30, and printing by each of the nozzle arrays 38, 39 are all controlled by the printer controller 78.

Figure 7:
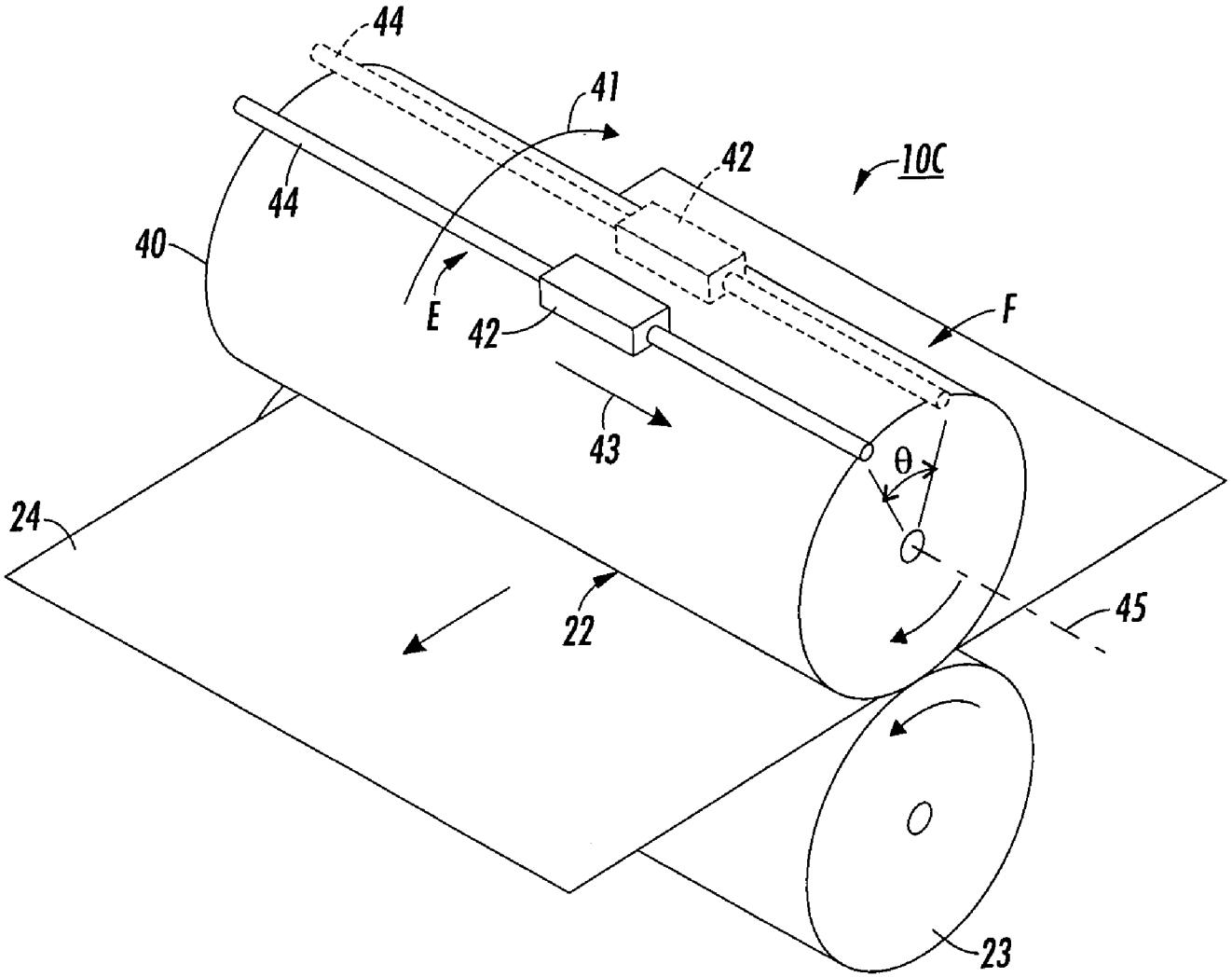
FIG. 7 is a schematic isometric view of another embodiment of the ink jet printer shown in FIG. 1, showing the intermediate member as a drum instead of a belt with the movement of the printhead conceptually shown by arrows.

A schematic representation of another exemplary embodiment of the ink jet printer 10C is shown in FIG. 7. In this embodiment, the intermediate belt 14 of the printer 10 in FIG. 1 has been replaced with a rotatable intermediate drum 40. The transfixing station 22 is again provided by a nip formed between the intermediate drum 40 and a heated pressure roll 23. A recording medium 24 is transported through nip 22 in timed relation and in registration with the swaths of information printed on the intermediate drum, so that the printed information is transfixed to the recording medium. As the intermediate drum 40 is rotated in the direction of arrow 41 at a constant velocity, the carriage 42 with printhead 12B (see FIG. 8) thereon confronts the intermediate drum and is transported back and forth across the width of the intermediate drum 40, as indicated by arrow 43. Concurrently, the printhead is moved in the same direction with the same velocity as the intermediate drum during the printing operation, in order to print swaths of information across the surface of the intermediate drum that are parallel to the axis of the intermediate drum. Thus, the carriage 42 is moved along at least one guide rail 44 in the direction of arrow 43, and the combined guide rail and carriage 42 are concurrently rotated about the axis of the intermediate drum back and forth through the angle θ. The guide rail and carriage are moved in the same direction and at the same velocity as the intermediate drum is rotated when the printhead is printing. The carriage completes a scan across the intermediate drum in the direction of arrow 43 when the guide rail and carriage has also completely traversed the angle θ from location E to location F, where the carriage and guide rail is shown in dashed line. At this time, the combined guide rail and carriage are quickly returned to location E, during which time the printhead does not eject ink droplets, and the scanning process is started again to print the subsequent swath of information. An exemplary mechanism for providing scanning of the printhead concurrently across the intermediate drum and rotation about the intermediate drum axis is discussed below with reference to FIG. 10.

Figure 8:
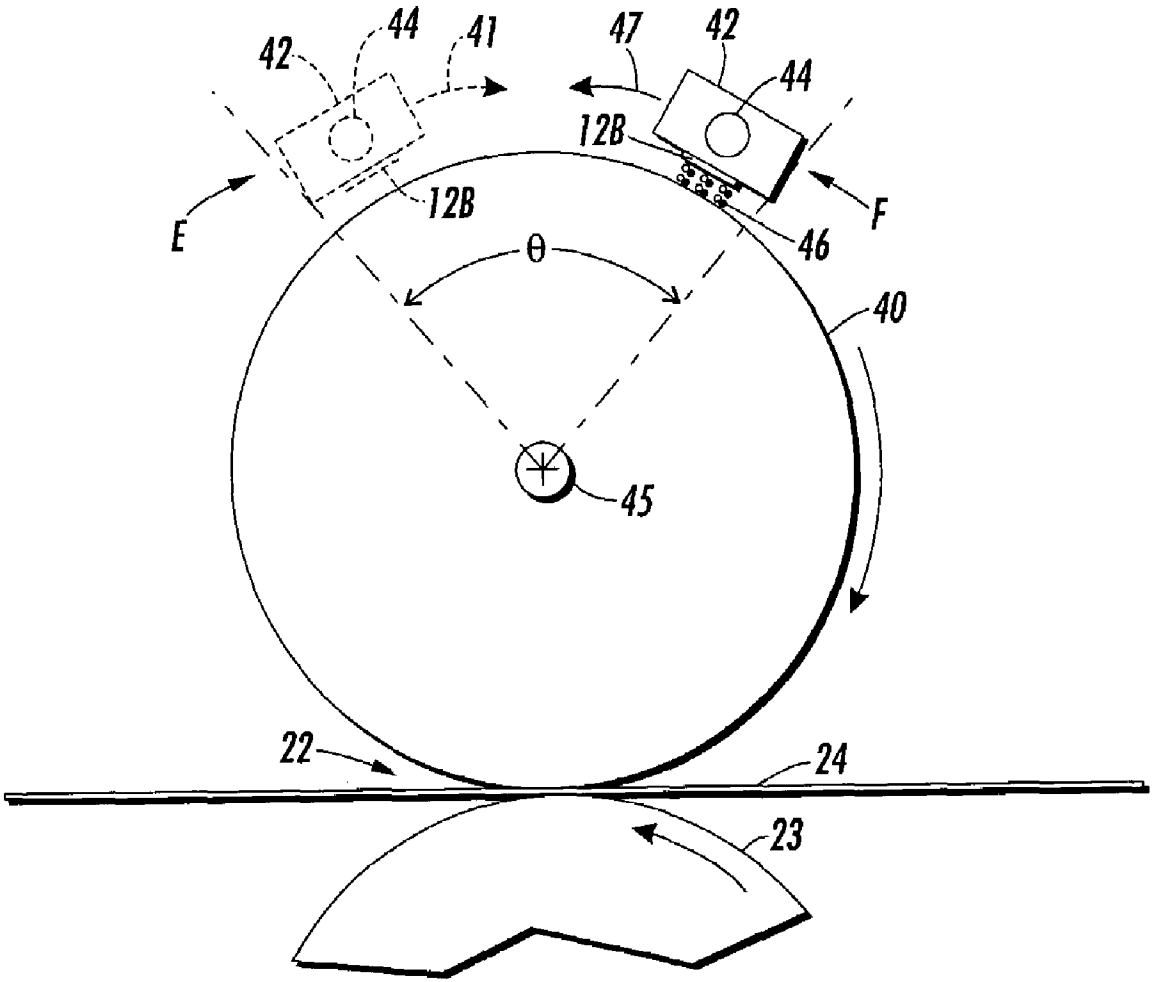
FIG. 8 is a side elevation view of the printer shown in FIG. 7, depicting the pivotal movement of the printhead about the intermediate drum axis.

In FIG. 8, a side elevation view of the ink jet printer shown in FIG. 7, is depicted, showing the pivotal back and forth movement of the combined guide rail and carriage about the intermediate drum axis 45. In this view, the carriage 42 with printhead 12 and guide rail 44 are shown in dashed line at location E. The carriage is moved along the guide rail in a direction normal to the drawing, while the combined guide rail and carriage are rotated about the intermediate drum axis 45 in the direction of arrow 41 for the angular distance θ. When the angle θ has been traversed, the carriage will have completed the movement across the intermediate drum. During the traversal of the printhead across the intermediate drum, a swath of information parallel to the intermediate drum axis will have been printed by ink droplets 46 ejected from the printhead. Once the combined guide rail and carriage has reached location F, the combined guide rail and carriage are immediately returned to location E, as indicated by arrow 47, and the printhead is ready to print the next swath of information. Recording medium 24 is shown passing through the transfixing nip 22 where the printed information on the intermediate drum is removed therefrom and transfixed to the recording medium.

Figure 9:
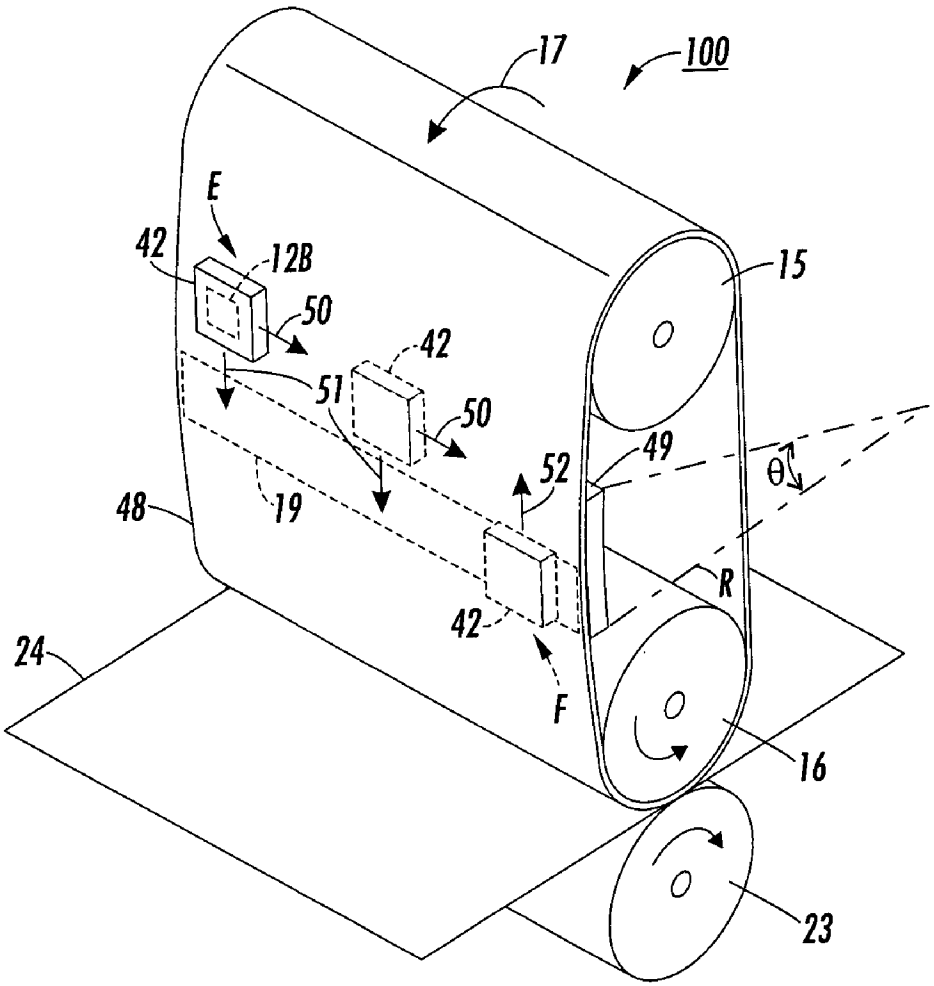
FIG. 9 is a schematic isometric view of still another embodiment of the ink jet printer shown in FIG. 1, depicting the intermediate member as a belt, a portion of which is curved about an acruate heater, and the printhead movement being shown by various printhead locations in dashed line with movement directions indicated by arrows.

A schematic representation of still another exemplary embodiment of the ink jet printer 10 shown in FIG. 1 is illustrated in FIG. 9 as ink jet printer 10D. In the embodiment of FIG. 9, the intermediate belt 48 has a curved portion in one span thereof that travels over a fixed curved heater plate 49. The outer surface of the curved portion of the intermediate belt confronts the region traveled by the two-dimensionally moving printhead 42 and defines a printing zone. The printing zone has at least the length and width of the curved heater plate that contacts the inner surface of the intermediate belt. The curved portion of the intermediate belt has a radius R. As the intermediate belt travels through the angular distance θ, the carriage 42 with the printhead 12 thereon travels from location E across the width of the intermediate belt 48 to location F. Thus, the two dimensionally movable printhead of this embodiment and the movement thereof is similar to that described with respect to FIGS. 7 and 8. The movement of the carriage is concurrently in two directions as indicated by arrows 50,51. The carriage is shown in dashed line at an intermediate location in the printing zone and at location F. Once the carriage reaches location F, the carriage and printhead is immediately moved in the direction of arrow 52 that is opposite to the direction of the intermediate belt for the distance of one or a portion of the height of a printed swath 19. Then the carriage is transported in the opposite direction from location F to location E, while concurrently moving in both a direction perpendicular and parallel to the direction of the intermediate belt. Upon arriving at location E, one back and forth cycle is completed, during which time two parallel swaths of information will have been printed.

Figure 10:
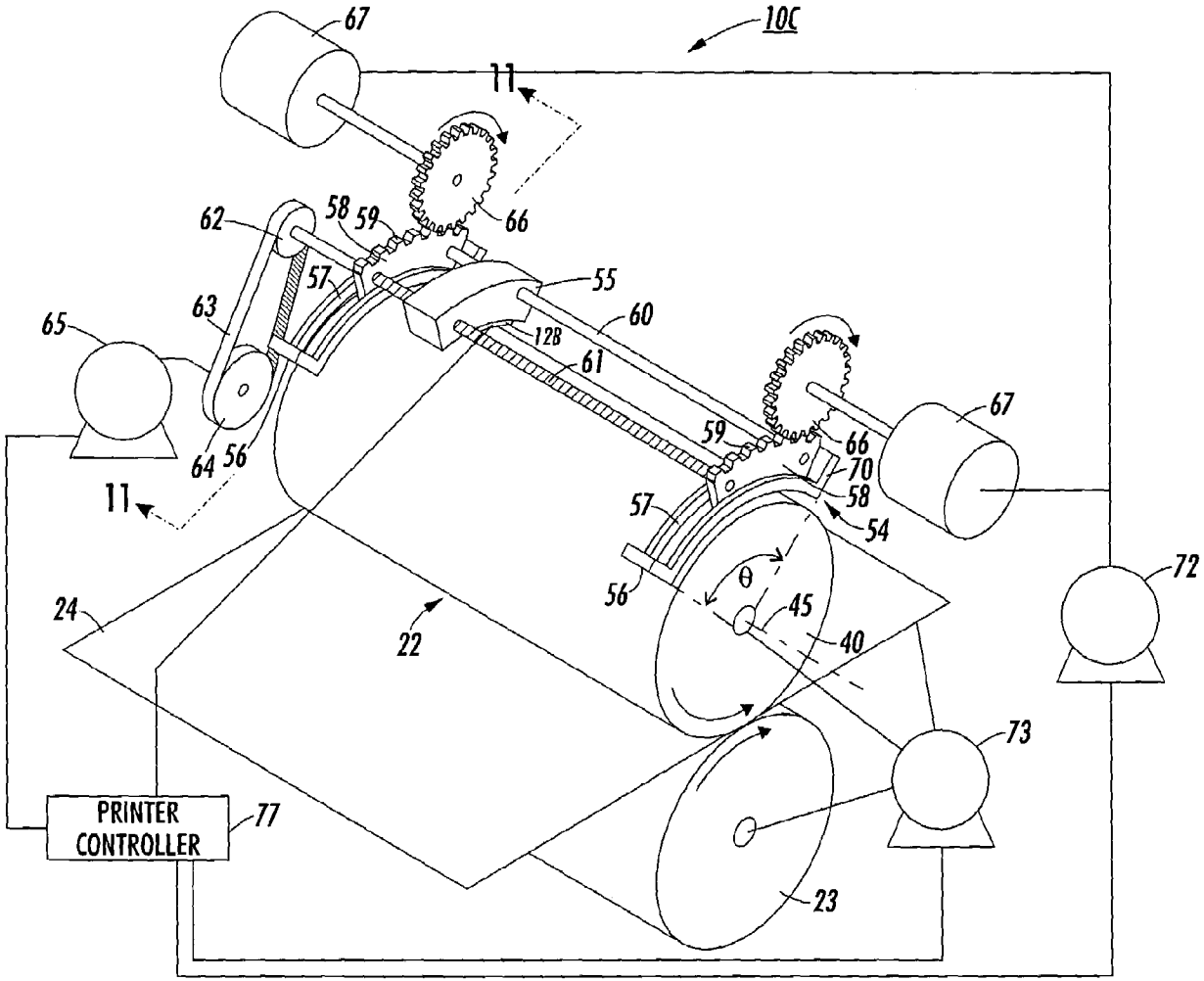
FIG. 10 is a schematic isometric view of the printer shown in FIG. 7, including another exemplary guiding apparatus for the two dimensionally moving printhead about an arcuate portion of the intermediate drum.

In FIG. 10, a schematic isometric view of the printer shown in FIGS. 7 and 8 is depicted, incorporating an exemplary transporting apparatus 54 that transports arcuate carriage 55 in a two dimensional direction with printhead 12B carried thereon back and forth across the intermediate drum 40. The intermediate drum is rotated about its axis 45 by electric motor 73 that also drives heated pressure roll 23 and causes the recording medium 24 to be advanced into the transfixing nip 22. A pair of elongated arcuate guide members 56 is fixedly mounted parallel to each other in the ink jet printer. Each of the arcuate guide members is located at opposing ends of the intermediate drum and has an elongated convex shaped recess 57 therein. The recesses 57 are also parallel to each other.

An elongated, arcuate slide member 58, having a length shorter than the recesses 57, is located in each of the recesses 57. Each slide member has a convex upper side and a concave lower side. The lower side of the slide member has a complementary shape with the recesses 57 and slidably resides in a respective recess 57. The slide members are slidable from one end of its respective recess 57 to the other. The convex upper side of the slide members, opposite the concave side in sliding contact with the recess 57, contains a set of linear gear teeth 59 substantially covering the entire length of the slide member.

At least one guide rail 60 fastens the slide members 58 together, so that the slide members and guide rail move as a single unit. In the embodiment shown, a second member interconnects the two slide members 58 and is in the form of a jack screw 61. The jack screw 61 and guide rail 60 are parallel to each other and are substantially perpendicular to the slide members 58. The arcuate carriage 55 is translatable mounted on the guide rail 60 and jack screw 61. The arcuate surface of the carriage 55 that confronts the intermediate drum 40 has substantially the same contour as the intermediate drum and contains the printhead 12B. In a preferred embodiment, the printhead 12B is also arcuately shaped to have the same contour as the intermediate drum, but this is not necessary. The only requirement is that the printhead remain spaced from the intermediate drum surface at all times. The carriage has a complementary female screw through which the jack screw travels in order to translate the carriage 55. A drive pulley 62 is mounted one end of the jack screw and moves with the combined assembly of slide members, guide rail and jack screw.

The drive pulley 62 is driven by a timing belt 63 mounted between drive pulley 62 and a stationary driven pulley 64 that is connected to a reversible electric motor 65. Thus, the electric motor 65 rotates the jack screw by way of the pulleys and moves the carriage with the printhead thereon across the intermediate drum 40 back and forth across the width of the intermediate drum and in a direction parallel to the intermediate drum axis 45. When the carriage completes the traverse across the intermediate drum, the electric motor 65 is reversed and the carriage 55 is returned back across the intermediate drum and the printhead 12 prints another swath of information parallel to the previously printed swath.

Concurrently with the translation of the carriage across the intermediate drum, the slide members 58 are moved in unison from one end of the recesses 57 in guide members 56 by a pair of stationary drive gears 66. Each of the drive gears 66 mesh with a one of a set of linear gear teeth 59 on the upper side of the slide members 58. The drive gears are synchronously driven to cause the slide members and thus the carriage that is mounted on the guide rail and jack screw to be moved from one end of the recesses in the guide members 56 to the other end. The drive gears are each driven through a clutch 67. A sensor 68 is located at each of the ends 70 of the recesses 57. When sensors 68 are contacted by the slide members 58, the sensors activate the clutches to enable electric motor 72 to rotate the drive gears in a direction to move the slide members concurrently in the same direction as the intermediate drum is rotated and at the same velocity. A sensor 69 is located at each of the ends 71 of the recesses 57. When the slide members 58 are moved along the recesses into contact with the sensors 69, the clutches 67 are deactivated, so that the drive gears may free wheel. A spring 74 (see FIG. 11) biases each of the slide members in the direction of ends 70 of the recesses 57, and once the clutches are deactivated, the springs urge the slide members immediately back into contact with the sensors 68. During the movement of slide members 58 from contact with sensor 69 to contact with sensor 68, the printhead does not eject ink droplets. The movement of the arcuate carriage 55, printing by the printhead 12B, as well as the movement of the intermediate drum 40, pressure roll 23, and recording medium 24 through the transfixing nip 22 are controlled by the printer controller 77.

Figure 11:
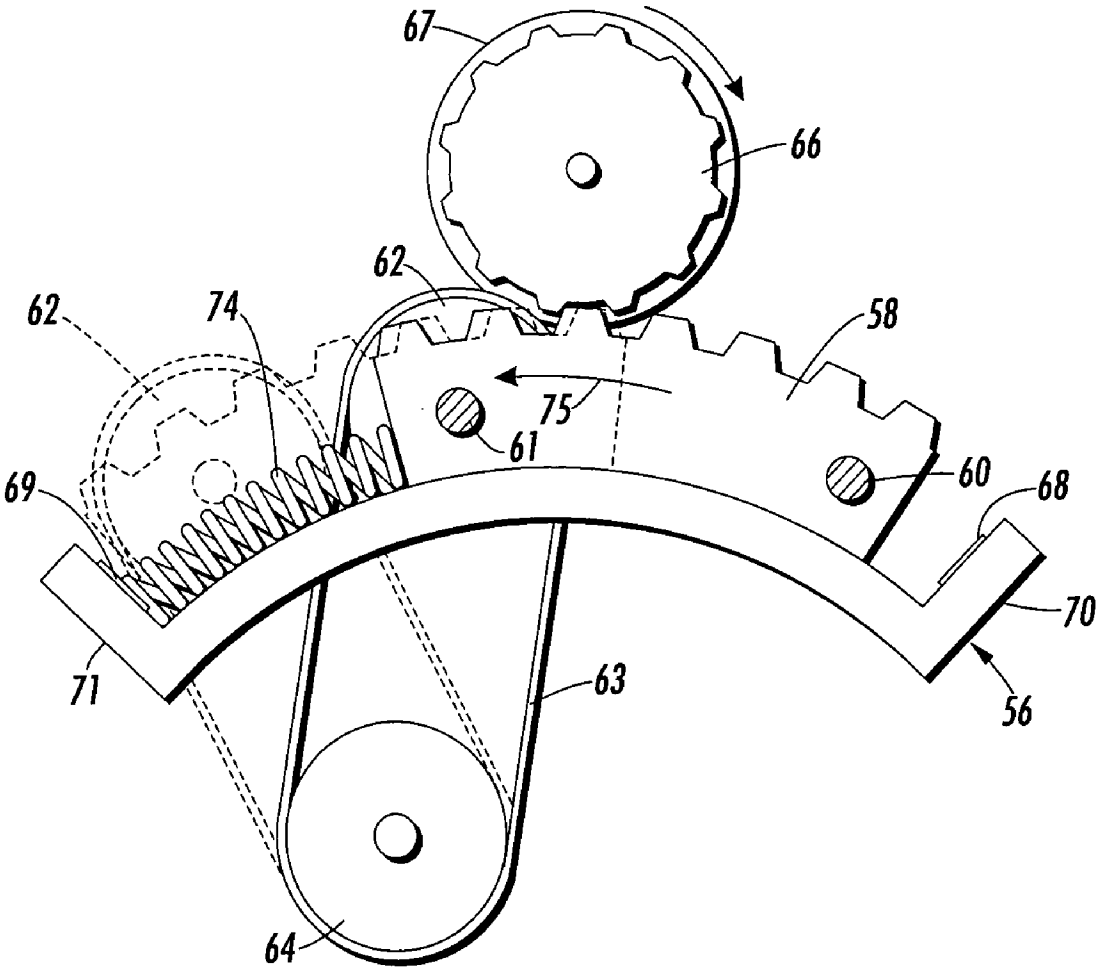
FIG. 11 is a cross-sectional view of a portion of the guiding apparatus of FIG. 10 as viewed along view line 11-11 therein.

FIG. 11 is a cross sectional view of a portion of the transporting apparatus 54 as viewed along view line 11-11 in FIG. 10. In this view, one of the arcuate guide members 56 is shown with the slide member 58 positioned against sensor 68 at recess end 70 of the guide member 56 by spring 74. As soon as the sensor 68 is contacted by the slide member, the clutch 67 is activated and electric motor 72 rotates the stationary drive gears 66. The drive gears overpower the spring 74 and moves the slide member 58 in a direction towards recess end 71 of the recess 57, as indicated by arrow 75. After the slide member is moved into contact with sensor 69, it is shown in dashed line. As the slide members are moved into contact with sensor 69, the drive pulley 62 mounted on the jack screw 61, also shown in dashed line, pivots about driven pulley 64 with the timing belt remaining in driving relationship between the two pulleys.

In accordance with the transporting apparatus 54 shown in FIGS. 10 and 11, the arcuate carriage 55 with the printhead thereon is moved concurrently in two dimensions as the printhead travels back and forth across the intermediate drum 40. The jack screw causes the carriage and thus the printhead to move along guide rail 60 in a direction perpendicular to the rotational direction of the intermediate drum. Concurrently, the drive gears 66, enmeshed with the set of linear gear teeth 59 of the slide members 58, cause the slide members to move along the recesses 57 in the arcuate guide members 56 in same direction as the intermediate drum and at the same velocity. The guide rail and jack screw interconnect the slide members, so that they move a single unit, carrying the printhead in the direction of the rotation of the intermediate drum for the angular distance θ. When the slide members reach the end of the recesses in the guide members, a swath of information is printed across the intermediate drum and sensors 69 deactivate the clutches 67 for the drive gears, thus allowing the drive gears to free wheel. With the drive gears disengaged, the biasing springs 74 to urge the slide members immediately back to their original position at end 70 of the guide member recess 57 and into contact with sensor 68. Sensor 68 causes the clutches to become activated to re-engage the electric motor 72 to the drive gears 66 and start the slide members moving again in the direction of movement of the intermediate drum and at the same velocity. Concurrently, reversible electric motor 65 is reversed and the printhead is moved by the jack screw along the guide rail to print another swath of information. This process is continued until the full image is printed on the intermediate drum. As the image comprising the swaths of information on the intermediate drum rotate through the transfixing nip 22, the image is transfixed to the recording medium 24. For partial swath height printing and overlap printing, additional sensors (not shown) may be positioned along the guide member recesses 57 to activate and deactivate the clutches 67.

In summary, an exemplary embodiment of this application relates to a solid ink or liquid ink based printer 10 that has a shuttling printhead 12 that moves in two dimensions while printing parallel swaths of images on a moving recording medium 24 or intermediate transfer belt 14 or drum 40. The printed swaths are perpendicular to the direction of movement of the recording medium, intermediate belt or drum. This printer may also have a transfixing station 22 where printed images on the intermediate belt or drum are transfixed to a recording medium 24, such as paper, at a constant speed.

In such an exemplary embodiment, a shuttling ink jet printhead 12 shuttles in the X direction like typical printers, but also moves in a direction perpendicular thereto or Y direction. The printhead ejects ink droplets onto a moving recording medium or rotating intermediate belt 14 or intermediate drum 40 that moves at a constant velocity. To form complete images on the recording medium, intermediate belt or drum, the printhead moves in the Y direction as it shuttles in the X direction, effectively chasing the moving recording medium or intermediate belt or drum surface, to form printed swaths 19,20 that are perpendicular to the moving direction of the recording medium, intermediate belt or intermediate drum. As the printhead reverses its X direction shuttle, it continues to advance in the Y direction to begin the next parallel swath in the appropriate location. If the image is not printed directly on a recording medium, the image is transfixed from the intermediate belt or drum to a recording medium at a constant velocity and may occur simultaneously with image printing.

The exemplary embodiment of this application has several significant benefits over the existing ink jet printers. For example, because the intermediate belt 14 or drum 40 moves at a constant velocity and printing can occur while transfixing occurs, the transfixing process can occur at a much slower speed than current printers. Because of the relatively low speed of the intermediate belt or drum surface, print quality and durability are substantially improved. In current solid ink printers, for example, the transfixing process runs at 20 inches per second or more with an output print speed of 10 pages per minute. Such speeds make it difficult to achieve good print quality in a single transfix step. In contrast, an exemplary embodiment of this application can achieve 10 pages per minute printing speed while transfixing at only 1.9 inches per second or less. The slower transfix speeds in the exemplary embodiment having a two dimensional shuttling printhead and a constantly moving intermediate belt or drum provide more time for the transferred ink to spread across and into the surface of the recording medium. Also, the slow transfixing speed is known to simplify materials requirements and reduces manufacturing costs.

Another benefit of the exemplary embodiment of this application is that this architectural approach reduces overall size and volume of a solid ink jet printer. This is because transfixing and imaging can occur simultaneously, so that the total length of the intermediate belt or drum surface can be shorter than the length of recording medium, such as paper. Indeed, the exemplary embodiment could be used with continuous feed or roll feed paper systems, including fanfold output. The exemplary printer 10 having a two dimensionally moving printhead 12 and intermediate belt 14 or drum 40 architecture is well suited for much smaller printhead packages, and a printer based on smaller printhead assemblies could more easily achieve lower energy use and low manufacturing cost.

Because the printed image remains on the intermediate belt or drum of the exemplary printer 10 of this application for a period of time before transfix to the recording medium, water or solvents in liquid inks could be substantially removed between the time it is applied to the intermediate belt or drum by the printhead and the time it reaches the transfixing nip 22. This advantage of the exemplary printer clearly supports use of liquid ink as well as solid ink. If necessary, a heating element (not shown) could apply heat to the printed image as it moves on the intermediate belt or drum from the print zone to the transfixing nip, causing water or solvents of the liquid inks to substantially evaporate prior to transfix.

Thus, the exemplary printer of this application provides the advantage of increased print quality and durability because the transfixing of the printed images can be conducted at a slower and constant rate. Also, the exemplary printer enables transfixing and image printing to occur simultaneously, so that the total length of the intermediate belt or drum surface can be shorter than the length of the recording medium. This feature provides the advantage of allowing smaller printer sizes and larger recording medium flexibility.

Although the foregoing description illustrates the preferred embodiment, other variations are possible and all such variations as will be apparent to those skilled in the art intended to be included within the scope of this application as defined by the following claims.

What is claimed is:

1. An ink jet printer having a two dimensional shuttle architecture for printing swaths of information, comprising:

a movable receiving member having opposing edges and being moved in a first direction at a constant velocity;

a movable printhead having at least one array of ink droplet ejecting nozzles, said array of nozzles being spaced from and substantially parallel to said receiving member, said printhead ejecting ink droplets from said array of nozzles onto said receiving member while said receiving member is being moved in said first direction; and means for shuttling said printhead back and forth across said receiving member between said opposing edges thereof concurrently in both said first direction and a second direction, said second direction being substantially perpendicular to said first direction, movement of said printhead in said first direction being at a velocity equal to said constant velocity of said receiving member, so that said ink droplets ejected from said array of nozzles in said printhead print parallel swaths of information across said receiving member that is substantially perpendicular to said first direction each time said printhead traverses across said receiving member.

2. The ink jet printer as claimed in claim 1, wherein said means for shuttling said printhead further comprises:

means for moving said printhead in a direction opposite the first direction for a distance of not more than a height of one printed swath of information each time said printhead arrives at one of the opposing edges of said receiving member prior to continued shuttling of said printhead.

3. The ink jet printer as claimed in claim 2, wherein said receiving member is a recording medium stationarily held on a moving transport belt, said transport belt being moved in said first direction at said constant velocity.

4. The ink jet printer as claimed in claim 2, wherein said receiving member is an intermediate surface from which said printed swaths of information are subsequently transfixed to a recording medium.

5. The ink jet printer as claimed in claim 4, wherein said printer further comprises:

a transfixing station for transfixing said printed swaths of information from said intermediate surface to a recording medium concurrently as other swaths of information are being printed on said intermediate surface.

6. The ink jet printer as claimed in claim 5, wherein said intermediate surface is an intermediate belt.

7. The ink jet printer as claimed in claim 6, wherein said means for shuttling said printhead comprises:

at least one fixed guide rail perpendicular to said first direction;

a translatable carriage mounted on said at least one guide rail for translation back and forth thereon in said second direction between said opposing edges of said intermediate belt;

a pair of pulleys being mounted in said carriage with a timing belt thereon, said pair of pulleys being coplanar with each other and separated by a span of said timing belt, the pulleys being rotatable about shafts perpendicular to said intermediate belt;

said printhead being mounted on said timing belt for movement from a first position to a second position between said pair of pulleys; and a reversible motor mounted on said carriage for driving one of said pair of pulleys, said reversible motor moving said printhead in said first direction from said first position to said second position at the same velocity as said intermediate belt, so that the combined movement of said carriage and movement on said printhead within said carriage by said reversible motor moves the printhead concurrently in two dimensions as the printhead traverses across the intermediate belt and enables the printhead to print swaths of information that are perpendicular to said moving direction of said intermediate belt.

8. The ink jet printer as claimed in claim 7, wherein said printer further comprises:

means for detecting arrival of said printhead at said second position within said carriage and for causing said reversible motor to return rapidly said printhead to the first position, said printhead arriving at said second position at substantially each time said carriage arrives at one of the opposing edges of said intermediate belt.

9. The ink jet printer as claimed in claim 6, wherein said means for shuttling said printhead comprises:

a pair of guide members fixedly mounted on opposite sides of said opposing edges of said intermediate belt, each guide member having an elongated slot that is parallel to each other and said first direction, said elongated slots each having a top end and a bottom end;

a slide member located in each of said slots of said pair of guide members;

means to move said slide members within said guide member slots;

at least one guide rail having opposing ends, each end of said guide rail being pivotally mounted to a one of said slide members;

a carriage having said printhead mounted thereon, said carriage being translatably mounted on said at least one guide rail for back and forth translation between said pair of guide members; and said slide members being positioned at opposite ends of said guide member slots, so that said at least one guide rail is skewed across said intermediate belt between said opposing edges thereof and translation of said carriage along said at least one guide rail moves said printhead concurrently in both said first and second directions and enables said printhead to print swaths of information that is perpendicular to said first direction.

10. The ink jet printer as claimed in claim 9, wherein said printhead has at least first and second arrays of nozzles, said first array of nozzles being parallel to said first direction when said carriage is translated from one of said opposing edges of said intermediate belt to the other and said second array of nozzles being parallel to said first direction, when said carriage is translated back from said other edge of said opposing edges to return said carriage to said one of said opposing edges.

11. The ink jet printer as claimed in claim 10, wherein ink droplets are ejected only from said first or second array of nozzles that are parallel to said first direction; and wherein said slide members are reversed from their positions in said guide member slots each time said carriage arrives at one of said opposing edges of said intermediate belt.

12. The ink jet printer as claimed in claim 6, wherein said intermediate belt has a curved portion in one span thereof on which said swaths of information are printed; and wherein said curved portion of said intermediate belt travels over a fixed curved heated plate.

13. The ink jet printer as claimed in claim 5, wherein said intermediate surface is an intermediate drum, said intermediate drum being rotated about its axis; and wherein said first direction is the direction of rotation of said intermediate drum.

14. The ink jet printer as claimed in claim 13, wherein said means for shuttling said printhead comprises:

at least on guide rail having opposing ends being held perpendicular to said first direction;

a carriage having said printhead mounted thereon, said carriage being mounted on said at least one guide rail for translation back and forth across said intermediate drum between said opposing ends thereof;

means for rotating said at least one guide rail with said carriage thereon back and forth about said axis of said intermediate drum between a first location and a second location, said first location and said second location being separated by the angular distance θ, said rotation of said at least one guide rail and carriage having a velocity substantially equal to said constant velocity of said intermediate drum;

means for translating said carriage back and forth on said at least one guide rail in said second direction, said carriage being moved from one end of said opposing ends of said intermediate drum to the other end of said opposing ends during the time said guide rail and carriage thereon has been rotated through said angular distance θ; and means for rotating said at least one guide rail and carriage thereon in a direction opposite said first direction for said angular distance θ from said second location back to said first location each time said carriage arrives at a one of said opposing ends of said intermediate drum.

15. The ink jet printer as claimed in claim 14, wherein said means for rotating said at least one guide rail with said carriage mounted thereon comprises:

a pair of elongated arcuate guide members fixedly mounted at each end of said opposing ends of said intermediate drum and parallel to each other, each arcuate guide member having an elongated convex shaped recess therein, said convex shaped recess being parallel with each other and having a predetermined length;

an arcuate slide member being located in each of the convex shaped recesses in said arcuate guide members, each arcuate slide member having a length shorter than said predetermined length of said convex shaped recesses, so that said arcuate slide members may slide from one end of said convex shaped recesses to the other;

each end of said at least one guide rail being attached to a respective one of said arcuate slide members, so that said arcuate slide members and said at least one guide rail with said carriage thereon move together as a single unit, when said arcuate slide members slidingly move in said convex shaped recesses; and drive means for sliding said arcuate slide members in said convex shaped recesses, so that said printhead on said carriage travel back and forth across said intermediate drum in both said first direction and said second direction.

16. The ink jet printer as claimed in claim 15, wherein said means for translating said carriage on said at least one guide rail comprises a jack screw driven by a reversible motor.

17. The ink jet printer as claimed in claim 15, wherein said drive means for sliding said arcuate slide members comprises:

a set of linear gear teeth on each of said arcuate slide members;

a drive gear meshed with each of said set of linear gear teeth on each arcuate slide member;

a clutch for each drive gear;

an electric motor to drive said drive gears through said clutches;

means to deactivate said clutches when a swath of information is printed by said printhead to allow said drive gears to free wheel; and means to bias said arcuate slide members toward said first location, so that said arcuate slide members are rapidly returned to said first location when said clutches are deactivated.

18. A method of printing with an ink jet printer having a two dimensional shuttle architecture, comprising the steps of:

moving an intermediate surface having opposing edges in a first direction at a constant velocity;

providing a movable printhead having at least one array of ink droplet ejecting nozzles that confronts and is substantially parallel to said intermediate surface;

shuttling said printhead concurrently in said first direction at a velocity equal to said constant velocity of said intermediate surface and in a second direction across said intermediate surface and between the opposing edges thereof, said second direction being substantially perpendicular to said first direction; and ejecting ink droplets from said printhead nozzles onto said moving intermediate surface while said printhead is being concurrently shuttled in said first and second directions, said printhead printing a swath of information having a predetermined height each time said printhead is shuttled across said intermediate surface from one end thereof to the other end, whereby said printed swaths of information are parallel to each other and perpendicular to said first direction.

19. The method of printing as claimed in claim 18, wherein said method further comprises the step of:

moving said printhead in a direction opposite said first direction for a distance equal to or less than the height of a swath of information each time a swath of information is completed.

20. The method of printing as claimed in claim 19, wherein the method further comprises the step of:

transfixing said printed swaths of information from said intermediate surface onto a recording medium concurrently as subsequent swaths of information are being printed on said intermediate surface.

* * * * *